United States Patent [19]

Kamitamari et al.

[11] Patent Number: 4,896,184

[45] Date of Patent: Jan. 23, 1990

[54] IMAGE FORMING APPARATUS WITH A DEVELOPING DEVICE

[75] Inventors: Manabu Kamitamari; Yoshiaki Takano, both of Osaka, Japan

[73] Assignee: Minolta Camera Kabushiki Kaisha, Osaka, Japan

[21] Appl. No.: 227,541

[22] Filed: Jul. 28, 1988

[30] Foreign Application Priority Data

Jul. 28, 1987 [JP] Japan ..... 62-189863

[51] Int. Cl.[4] ..... G03G 15/08

[52] U.S. Cl. ..... 355/206; 355/245; 118/694

[58] Field of Search ..... 355/3 DD, 14 D, 203–206, 355/208, 9, 245, 246; 118/688, 693, 694

[56] References Cited

U.S. PATENT DOCUMENTS 4,338,019 7/1982 Terashima et al. ..... 355/246

4,477,173 10/1984 Kozuka et al. ..... 355/3 DD

FOREIGN PATENT DOCUMENTS 48-38157 6/1973 Japan .

50-19459 2/1975 Japan .

58-179879 10/1983 Japan .

59-178469 10/1984 Japan ..... 355/3 DD 61-160457 10/1986 Japan .

*Primary Examiner*—Arthur T. Grimley

*Assistant Examiner*—J. Pendegrass

*Attorney, Agent, or Firm*—Wenderoth, Lind & Ponack

[57] ABSTRACT

The present invention relates to an image forming apparatus with a developing device in which first and second detecting elements are provided respectively at opposite ends of the device to detect that substantially same amounts of developer are present in both ends. By this, the image forming apparatus is permitted to start image formation only when the developer is evenly dispersed in the both ends of the device.

6 Claims, 7 Drawing Sheets

IMAGE FORMING APPARATUS WITH A DEVELOPING DEVICE

BACKGROUND OF THE INVENTION

The present invention relates to an image forming apparatus such as printers and copy machines which employ powder developers, and more specifically relates to a developing device actuation control in said image forming apparatus.

Small, light weight portable copy machines and copy machines with replaceable developing devices containing different color developers have been provided in recent years.

However, certain disadvantages of portable copy machines are encountered when developer accumulates to one side of the developing device as the machine is transported, thereby causing one side of the copy image to be abnormally dense when the first copies are made, or actually preventing the formation of any copy image at all.

Also, replaceable developing devices must maintained in a horizontal position when not installed in a copy machine or else the developer will accumulate at one side as in the case of the aforesaid portable copy machine, and lead to the previously described disadvantages.

SUMMARY OF THE INVENTION

A main object of the present invention is to provide an image forming apparatus which normally produces superior images while preventing the occurrence of defective images caused by developer accumulation at a side of the developing device.

Another object of the present invention is to provide an image forming apparatus which detects the accumulation of developer at a side of the developing device and inhibits the copy process.

These and other objects of the invention are accomplished by providing an image forming apparatus that provides developer detection means inboard and front side of the developing device which transmit signals after power is applied, and which permits the image forming process to proceed when it is determined that developer meets or exceeds a predetermined volume at the inboard and front side of said developing device based on the output signals of the aforesaid developer detection means.

These and other objects, advantages and features of the invention will become apparent from the following description thereof taken in conjunction with the accompanying drawings which illustrate specific embodiments of the invention.

DETAILED DESCRIPTION OF THE INVENTION

The present invention is described hereinafter with reference to the accompanying drawings which show a single embodiment thereof.

Figure 1:
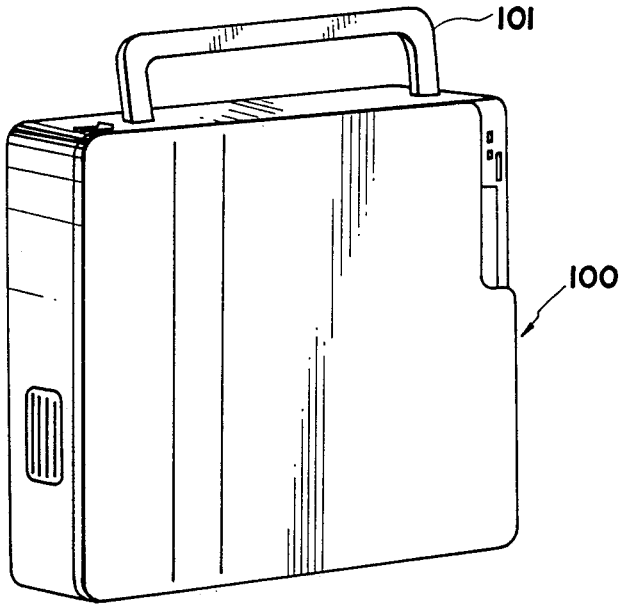
FIG. 1 shows an exterior view of a portable copy machine of the present invention.

FIG. 1 shows a portable copy machine 100 which can be carried by handle 101 and can be opened and closed.

Figure 2:
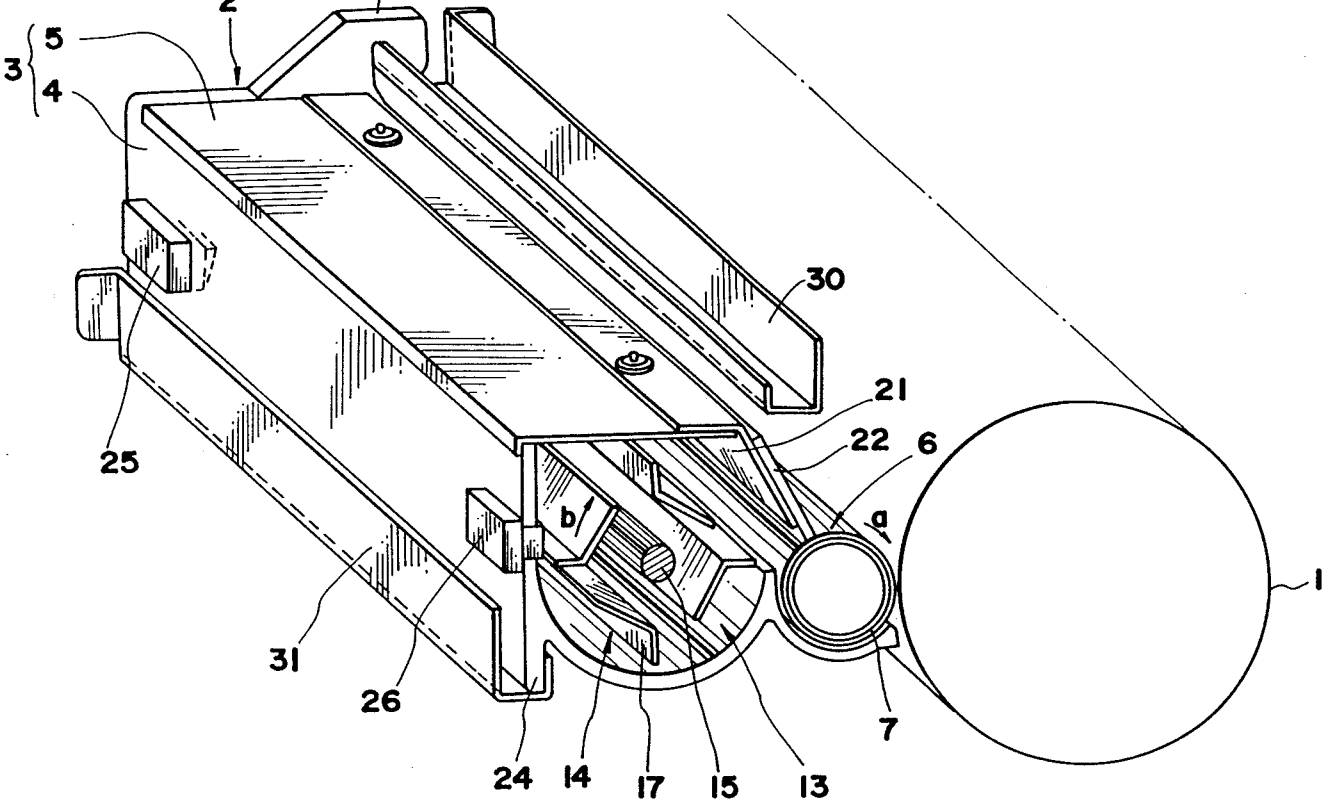
FIG. 2 is a perspective view of the copier developing device of the invention.

FIG. 2 shows developing device 2 installed in the aforesaid copy machine 100.

Housing 3 of developing device 2 comprises casing 4 and cover 5, developing portion 6 in the fore part and developer mixing portion 13 (hereinafter referred to as mixing portion 13) in the rear part. A developing roller 7 is provided with an internal magnetic roller in developing portion 6, and a bucket roller 14 is provided in the mixing portion 13.

Figure 3:
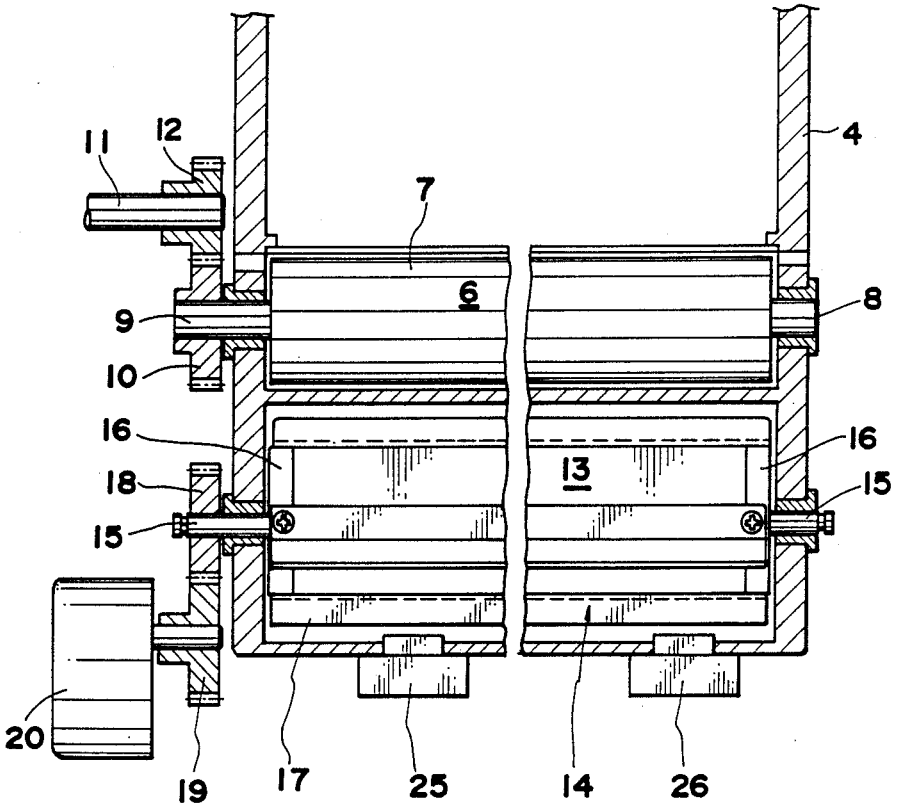
FIG. 3 is a transverse cross section view of said developing device.

Developing roller 7 is rotatably mounted to casing 4 via shafts 8 and 9 attached to either end, as shown in FIG. 3, and gear 10 attached to the interior side shaft 9 engages a drive gear 12 on drive shaft 11 connected to a drive motor (not shown in the drawing) so as to be rotated in the direction of arrow "a."

A brush height regulating panel 22 is provided via support panel 21 attached to cover 5 diagonally above and to the rear of developing roller 7, the leading edge of said brush height regulating panel 22 and the surface of said developing roller 7 having a prescribed brush height regulating gap formed therebetween.

Bucket roller 14 is provided with a plurality of buckets 17 at side panels 16 mounted at both ends of shafts 15, as shown in FIG. 3. The aforesaid both sides of shafts 15 are rotatably supported by the side walls of casing 4, and a gear 18 attached to the inboard shaft 15 engages a gear 19 attached to the drive shaft of mixing motor 20 so as to be rotatably driven in the direction of arrow "b."

At the rear wall of casing 4 are provided pressure sensors 25 and 26 as developer detection means located at both ends of the inboard and frontal sides, the sensing aspects of said pressure sensors 25 and 26 being oriented toward the mixing portion 13. These sensors detect the developer distribution volume by detecting whether or not the developer is distributed near equally to both sides of the developing device through the output signals of both sensors.

Hooks 23 are provided at both inboard and frontal sides at the top portion of casing 4 (only one side shown in the drawings), and an undercarriage 24 is formed at the rear of casing 4.

The developing device 2 of the aforesaid construction provides a support member 30 attached to the copy machine body which is linked to the hooks 23, undercarriage 24 supported by another support member 31, and photosensitive drum 1 mounted to the side portions thereof, as shown in FIG. 2. Developing roller 7 and photosensitive drum 1 are mounted so as to maintain a specified gap therebetween.

Figure 4:
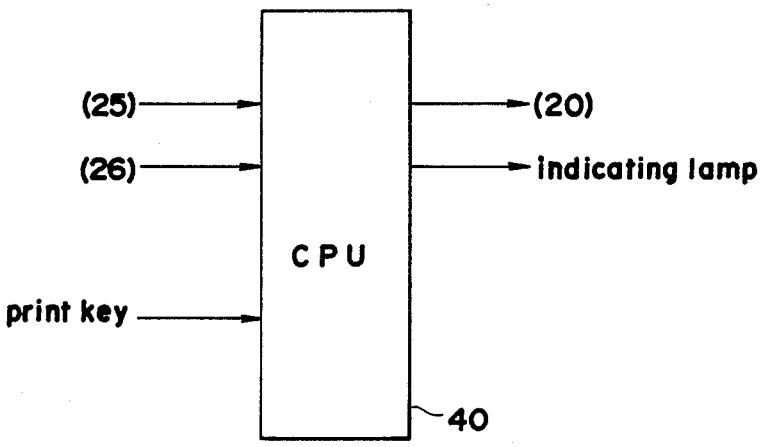
FIG. 4 is a control circuit diagram for the copy machine.

The control circuit of copy machine 100 is shown in FIG. 4. The control circuit of central processing unit (CPU) 40 receives signals transmitted by sensors 25 and 26 and outputs signals to mixing motor 20. CPU 40 is provided with an operation panel (not shown in the drawings) having a variety of keys such as print control keys and the like by which signals can be entered to the CPU, and which switch ON and OFF various display lamps also provided on the operation portion.

According to the aforesaid construction, a bicomponent developer comprising a toner and a carrier is stored in developing device 2 and is mixed by the rotation of bucket roller 14. A portion of said developer is supplied to the surface of developing roller 7.

The developer supplied to developing roller 7 travels in the direction of arrow "a" and its flow is regulated by a brush height regulating panel 22. The developer then renders visible the electrostatic latent image formed on the surface of the photosensitive drum 1 in the area opposite said photosensitive drum 1, and is subsequently returned to the mixing portion 13.

Because copy machine 100 is portable, developer in developing device 2 accumulates at the inboard or front sides when said machine 100 is transported. When the copy process is initiated with the developer in the described state, the developer will be unevenly distributed and excessively thick or thin on one side only.

Therefore, the sensors 25 and 26 provided in copy machine 100 detect the developer, and the copy process is allowed to start or inhibited based upon the results of said detection.

The control of this process is described hereinafter with reference to the flow charts shown in FIGS. 5 to 7.

Figure 5:
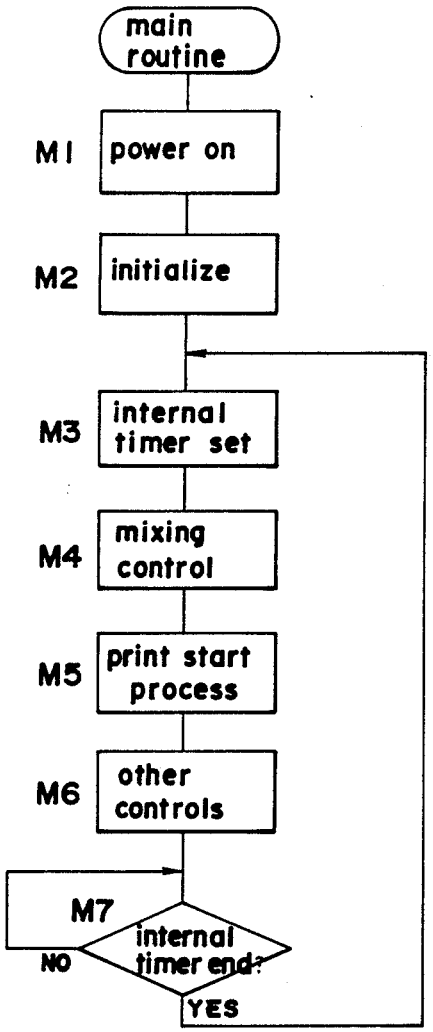
FIG. 5 is a flow chart showing the main control routine copy machine.

(i) Main Routine (see FIG. 5)

The main routine shown in FIG. 5 briefly describes the operation of copy machine 100. In step M1, power is switched ON to the copy machine 100. In step M2, CPU 32 random access memory (RAM) is cleared, and each register of the CPU is initialized at default settings to set the device in the initialization mode.

In step M3, the internal timer is started which manages the main routine set at initialization, and in step M4 the mixing subroutine, in step M5 the start print subroutine, and in step M6 other control subroutines are respectively executed. The mixing and start print subroutines are described more specifically below.

When the aforesaid subroutines are completed, the completion of the internal timer set at initialization is awaited to complete the processing of one routine in step M7, then the program returns to step M3. Each timer actuated during a subroutine counts by using the length of the period of one routine. That is, each timer counts the number of repetitions of one routine to determine the termination point.

Figure 6A:
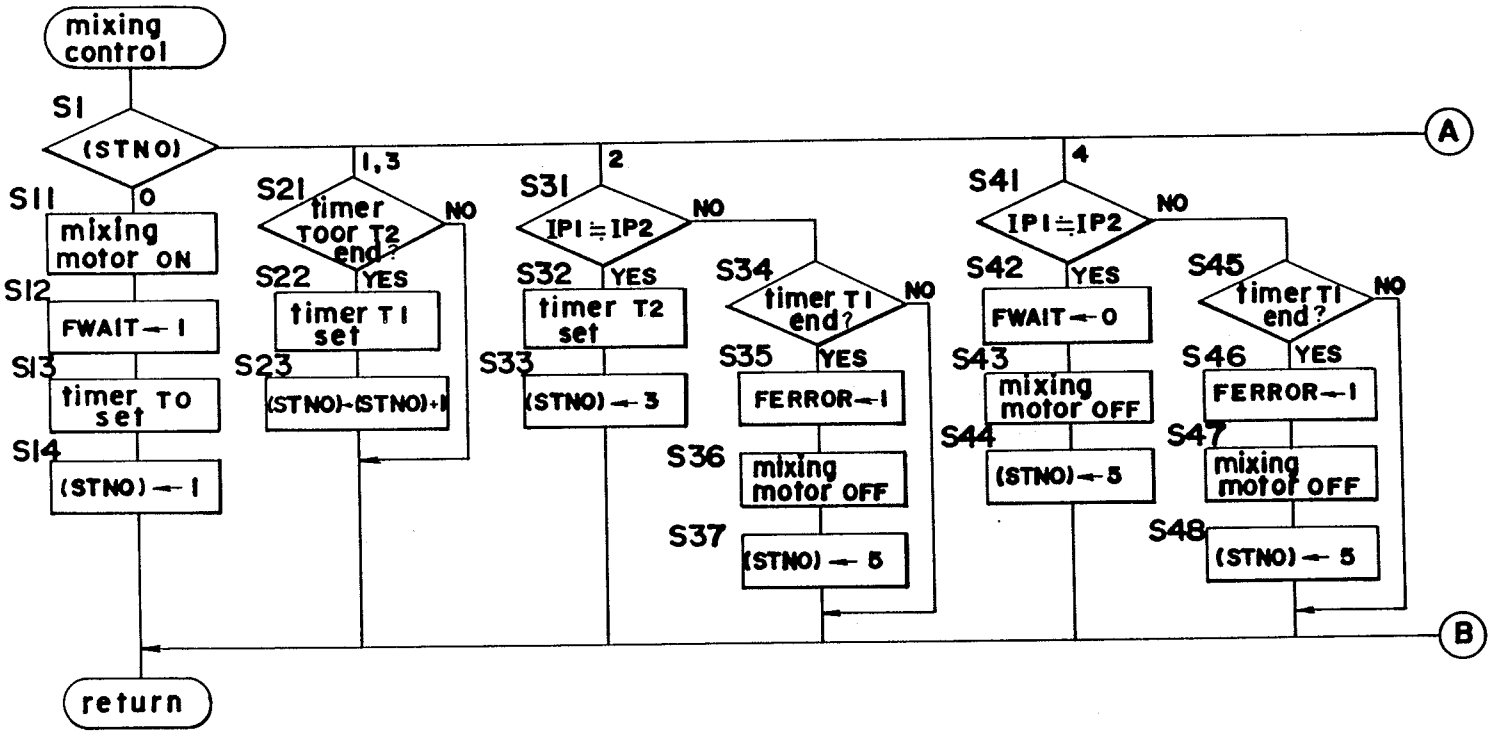
FIGS. 6(*a*) and 6(*b*) are flow charts showing the mixing control subroutine for the developing device.
Figure 6B:
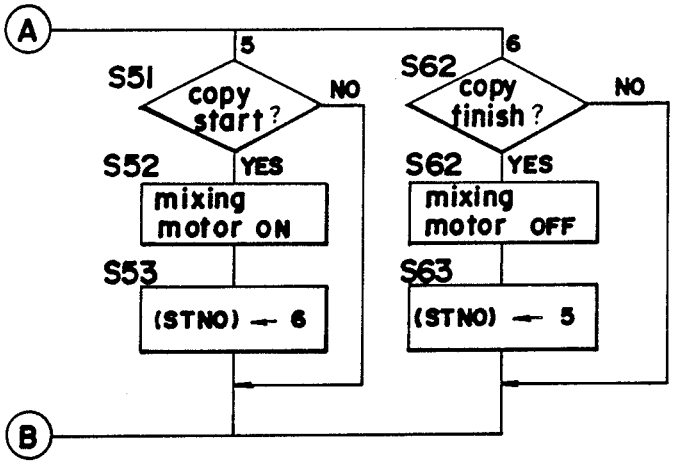

(ii) Mixing Control Subroutine (see FIGS. 6(*a*) and 6(*b*))

In step S1 of the mixing control subroutine, the statement number (hereinafter referred to as STNO) is determined. When power is applied to copy machine 100, STNO is set to "0" (zero) in the initialization subroutine of the main routine, and after power ON the program continues to step S11 of the first routine.

In step S11, the mixing motor 20 is started to mix the developer contained in the mixing portion 13, then in step 12, the FWAIT flag is set at "1." The FWAIT flag is one of the start copy conditions. When FWAIT is set at "1" the copy operation cannot start eve when the print key (not shown in the drawing) is depressed. A copy operation can start only when FWAIT is set at "0."

Subsequently, in step S13 the detection-start delay timer T0, which delays the detection of sensors 25 and 26, is set, and the routine continues to step S14 where STNO is set to "1."

When STNO is "1" or "3" the routine continues to step S21 where it is determined whether or not the aforesaid detection-start delay timer T0 set in step S13 or timer T2 (described later) has ended. If the timer has ended, trouble detection timer T1 is set in step S22, and the routine continues to step S23 where STNO is incremented by "1," i.e., if STNO is set at "1" or "3," its value after incrementation is "2" or "4."

When STNO is set at "2," then in step S31 the input values IP1 and IP2, which are transmitted to the CPU 40 from sensors 25 and 26 respectively, are checked to determine whether or not they are nearly equal. In other words, immediately after the power is applied a determination is made as to whether or not the developer is distributed nearly equally between the inboard side and front side of developing device 2.

When it is determined that developer is nearly uniformly distributed between both ends of the inboard and frontal sides of developing device 2, the redetect-start delay timer T2 is started in step S32, then STNO is set at "3" in step S33, and subsequently the routine executes the aforesaid steps S21 through S23.

On the other hand, when developer has accumulated at the inboard or frontal sides of developing device 2, then in step S34, the trouble detection timer T1 set in the previous step S22 is checked to determine whether or not it has terminated. When the input values IP1 and IP2 of sensors 25 and 26 are not nearly equal during the time period of timer T1, i.e., when it is determined that developer is not uniformly distributed to the inboard and frontal sides during the time period of timer T1, then the FERROR flag is set at "1" in step S35. In step S36, the mixing motor 20 is switched OFF, and in step S37 STNO is set at "5."

When STNO is set at "4," i.e., when it has once been determined that the developer at the inboard side and front side of developing device 2 is level and the input values IP1 and IP2 of sensors 25 and 26 are near equal, a second determination is made in step S41 as to whether or not the input values IP1 and IP2 are near equal.

When both input values IP1 and IP2 are near equal the routine continues to step S42 where the FWAIT flag is set at "0," then in step S43 mixing motor 20 is switched OFF, and in step S44 STNO is set at "5."

In step S45, when the input values IP1 and IP2 are near equal in spite of the mixing operation during timer T1, the FERROR flag is set at "1" in step S46. Then in step S47, the mixing motor 20 is switched OFF, whereupon in step S48 the STNO is set at "5."

When STNO is set at "5," a check is made in step S51 to determine if the copy operation has started. If the copy operation has started, then the mixing motor 20 is switched ON in step S52. In step S53, the STNO is set at "6."

When STNO is set at "6," i.e. during a copy operation, a check is made in step S61 to determine if the process has ended. If the copy operation has ended, the mixing motor 20 is switched OFF in step S62, and STNO is set at "5" in step S63.

Figure 7:
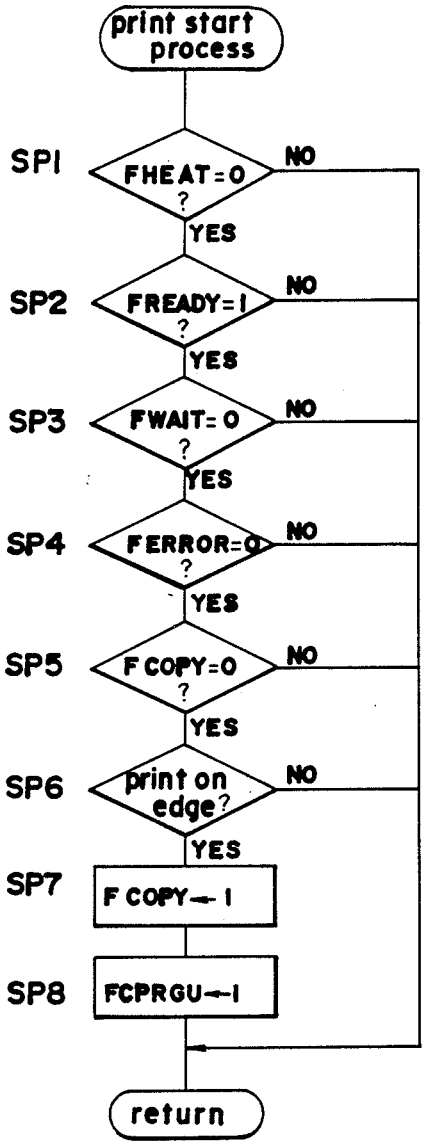
FIG. 7 is a flow chart showing the starting process subroutine of the copy process.

(iii) Start Print Process Subroutine (see FIG. 7)

The start print process subroutine is the subroutine which allows the printing process to start. In step SP1, a check is made to determine whether or not the FHEAT flag is set at "0." The fixing roller in the fixing device (not shown in the drawings) is heated to a prescribed temperature, then the routine continues to step SP2.

In step SP2, the FREADY flag is checked to determine whether or not it is set at "1." If no wait state is prescribed to move the optical system projection lens (not shown in the drawings) to vary the copy magnification, the routine continues to step SP3.

In step SP3, the FWAIT flag is checked for a "0" value, then in step SP4 the FERROR flag is checked to determine whether or not it is set at "0." The FWAIT flag is set in step S12 or S42 of the previously described mixing control subroutine. After power is switched ON, said FWAIT flag is set at "0" (copy start permissive state) only when the input values IP1 and IP2 detected by sensors 25 and 26 are determined to be near equal a second time. Further, the FERROR flag is also set at "1" when trouble arises such as a paper jam and the like and, although set in steps S35 and S46 of the mixing subroutine, is set at "1" when it is determined that the input values of IP1 and IP2 are not near equal a second time.

With both the FWAIT and FERROR flags at "0," and both input values IP1 and IP2 near equal (developer is uniformly distributed between the inboard and frontal sides), the routine continues to step SP5. When it is determined that input values IP1 and IP2 are not near equal (developer accumulated at on side), the routine returns to the origin and a copy inhibit state is maintained.

In step SP5, a determination is made as to whether or not the FCOPY flag is set at "0," and the routine continues to step SP6 if the copy process is not in progress. If the print key on-edge condition is detected in step SP6, then the FCOPY flag is set at "1" in step SP7 and the copy operation is permitted. In step SP8, the FCPRGU flag is set at "1" and the copy operation starts.

Thus, the copy machine 100 of the present invention permits the copy operation to occur after power ON only when the developer is stored uniformly between the inboard an frontal sides of the mixing portion 13.

Pressure sensors are used in the aforesaid embodiment as for sensors 25 and 26 so as to detect the developer volume by detecting the pressure applied by said developer upon the sensor, however, magnetic sensors may also be used to magnetically detect said developer volume, or ultrasonic or other sensors may be used.

When copy machine 100 is provided magnetic sensors in the developing device 2, the toner and carrier mixture ratio is detected as a variation in magnetic permeability and the toner resupply is regulated based on the results of said detection. When the aforesaid magnetic sensors are provided at the inboard and frontal sides of developing device 2, the aforesaid detection results effectively describe developer volume.

In the present embodiment, sensors 25 and 26 are provided at the rear wall of casing 4, but are not limited to said placement since they may also be provided at the bottom of casing 4, and depending on the type of sensor employed may further be provided at the front or top of casing 4.

In the present embodiment, the copy operation is permitted to start only when the condition is met of near equal developer volume at the inboard and frontal sides, but is not limited to said condition and the copy operation may be permitted to start even when developer volume is unequal but developer is present on both sides. Since the developer is continually mixed during the copy operation, this latter condition does not present a problem.

In the present embodiment, sensors 25 and 26 are respectively provided at the inboard and frontal sides of developing device 2, but another sensor may be provided medially to the aforesaid sensors so as to regulate the copy formation operation to obtain superior effectiveness.

The present invention is not limited in application to portable copy machines, but may be used in copy machines and printers with replaceable developing devices, for example to change developer color, and image forming apparatus such as copy machines and printers which are detachable from the copy machine body comprising a photosensitive member and developing device in a single unit.

According to the present invention as described above, the image formation operation does not execute when power is applied after the the portable image forming apparatus has been transported to a new location or the developing device has been replaced and the developer is absent from either the inboard or frontal side of said developing device.

Thus, images are uniformly reproduced, and high quality images can be obtained.

Although the present invention has been fully described by way of examples with reference to the accompanying drawings, it is to be noted that various changes and modifications will become apparent to those skilled in the art. Therefore, unless otherwise such changes and modifications depart from the scope of the present invention, they should be construed as being included therein.

What is claimed is:

1. An image forming apparatus comprising:

a developing device containing developer powder for developing an image;

a first detecting means for detecting the developer at one end of the developing device;

a second detecting means for detecting the developer at other end opposite to the one end of the developing device; and control means for determining whether the substantial amount of the developer is detected by both of said first and second detecting means and permitting image formation when both of said detecting means detect the substantial amount of the developer.

2. An image forming apparatus comprising:

a developing device containing developer powder and including means to develop an image formed on an image bearing member;

a first detecting means provided at one end of said developing device for detecting amount of the developer present in one end of the developing device and outputting first signal indicative of the amount of developer detected;

a second detecting means provided at other end opposite to the one end of the developing device for detecting amount of the developer present in the other end and outputting second signal indicative of the amount of developer detected;

comparing means for comparing said first signal with said second signal and outputting third signal when the amounts of developer detected are substantially similar and outputting fourth signal when the amounts of developer detected are not similar; and control means for permitting an image formation to start upon receipt of said third signal and for inhibiting the image formation by receipt of the fourth signal.

3. An image forming apparatus as claimed in claim 2 wherein said developing device includes a developer storing compartment adjacent said develop means and said first and second detecting means are provided at respective ends of said compartment.

4. An image forming apparatus as claimed in claim 3 wherein said compartment further include an agitating means for agitating the developer.

5. An image forming apparatus which includes:

an image bearing member on which an image is formed;

a developing device provided adjacent said image bearing member and including an agitating section with a developer powder for agitating and transporting the developer and a developing section with a developing mean to develop the image;

a first detecting means provided at one end of said agitating section for detecting an amount of developer present in said one end;

a second detecting means provided at other end of said agitating section which is remote and opposite from said one end for detecting an amount of developer in the other end;

means for determining whether the substantial amounts of the developer are present in both one and other ends in accordance with the outputs from said first and second detecting means; and control means for permitting image formation to start when said determining means determines that the substantial amount of developer are present in the both ends.

6. An image forming apparatus as claimed in claim 5 wherein said first and second detecting means detect the amounts of developer following the energization to drive said developing device.

* * * * *